United States Patent [19]

Kern

[11] 3,969,279

[45] July 13, 1976

[54] METHOD OF TREATING ELECTRON EMISSIVE CATHODES

[75] Inventor: Edmund R. Kern, Hampton, N.H.

[73] Assignee: International Telephone and Telegraph Corporation, Nutley, N.J.

[22] Filed: Aug. 13, 1974

[21] Appl. No.: 497,026

[52] U.S. Cl. ..... 252/521; 252/500; 313/346 R

[51] Int. Cl.[2] ..... H01B 1/08

[58] Field of Search ..... 313/346 R, 109, 346.3; 117/223, 33.5 L, 62; 252/521, 500; 428/471; 427/77

[56] References Cited

UNITED STATES PATENTS

| | | | |
|---|---|---|---|
| 2,917,415 | 12/1959 | Levi | 117/223 |
| 3,017,365 | 1/1962 | Harrison | 117/33.5 L |
| 3,441,438 | 4/1969 | Weiss | 117/223 |
| 3,597,271 | 8/1971 | Cawley et al. | 117/223 |
| 3,642,527 | 2/1972 | Purdes et al. | 117/223 |
| 3,718,831 | 2/1973 | Butter et al. | 313/346 R |
| 3,766,423 | 10/1973 | Menelly | 313/346 R X |
| 3,842,469 | 10/1974 | Menelly | 313/346 R X |

*Primary Examiner*—Benjamin R. Padgett
*Assistant Examiner*—E. Suzanne Parr
*Attorney, Agent, or Firm*—John T. O'Halloran; Peter Van Der Sluys; Richard A. Menelly

[57] ABSTRACT

Firing electron emissive compounds of barium tantalate in excess of 1600°C in controlled vacuum conditions removes elemental barium from the compound. The method provides improved fluorescent lamp quality by yielding substantially less end discoloration over the life of the lamps.

4 Claims, 6 Drawing Figures

METHOD OF TREATING ELECTRON EMISSIVE CATHODES

BACKGROUND OF THE INVENTION

The advent of novel electron emissive materials to low pressure and high pressure type lamps has lead to substantial increases in lamp operating lifetimes.

One example is the use of barium peroxide and tantalate metal to produce a fused-porous electron emissive body having a density gradient structure as disclosed in the U.S. Pat. No. 3,798,492 issued to R. Menelly and assigned to the assignee of the instant invention. Menelly teaches that when the electron emissive material is given the porosity and the bulk density gradient as described therein, the electron emission readily occurs at lower electrode operational temperatures than with the standard alkaline earth carbonate mix.

Another example of novel emissive materials is the use of alkaline earth tantalate emissive coatings as disclosed within the following U.S. applications: Ser. No. 487,409, filed July 10, 1974, entitled "Emissive Coating for Electrodes"; and Ser. No. 487,082, filed July 10, 1974, entitled "Electron Emissive Coatings". Kern teaches the use of barium tantalate having a high barium oxide to tantalum oxide ratio and barium calcium tantalate where the barium and calcium content are approximately equivalent and where the barium-calcium oxide content is high relative to the tantalum oxide content to produce large quantities of emissive coatings for fluorescent lamp electrodes. However the use of fused density gradient structures and tantalate compounds adversely effect some of the lamp operating properties. One of the lamp properties particularly involved is the incidence of formation of end discoloratin which is the dark deposit that occurs in the vicinity of the lamp operating electrodes at both ends of the lamp after a few hundred hours of lamp operation. As described in the aforementioned applications these deposits are believed to comprise compounds formed by the reaction of barium metal with mercury and oxides of mercury.

Since the barium-tantalum and barium-calcium-tantalum compounds are rendered electron emissive by controlled heating in the absence of oxygen it is felt that excess barium may be produced in the heat treatment process. The unusual early occurrence of end discoloration with these tantalate compounds may quite possibly be due to the presence of the excess barium and calcium on the surface of the compound. Since the elemental barium and calcium vapor pressure is quite high relative to the vapor pressure of the barium-calcium tantalate a series of experiments were designed in order to determine whether the excess elemental barium and calcium could be removed by thermal evaporation without affecting the electron emissive properties of the overall tantalate compound.

SUMMARY OF THE INVENTION

Alkaline earth tantalates of the type having high barium oxide to tantalum oxide ratios and used as electron emissive coatings on fluorescent lamp filaments are heated in an oxygen free ambient to a temperature in excess of 1600°C for a period of time ranging from one to ten minutes in order to remove excess free alkaline earth metal from the tantalate. The end discoloration formation rate is substantially decreased by this process while the lamp operating life is increased.

DESCRIPTION OF THE PREFERRED EMBODIMENT

A 50 gram batch of barium tantalate having the composition $Ba_5 Ta_2O_{10}$ was first heated in an alumina crucible to 1000°C for ten minutes in order to render the compound electron emissive. The heating occurred in an evacuated chamber and the electron emissive properties were determined by the nature of the barium tantalate color. As the compound was heated in the absence of oxygen the color changed from white to a grayish brown after being held at the 1000°C temperature for approximately ten minutes. Allowing sufficient time for cooling in the evacuated chamber the compound was removed and applied in paste form to fluorescent lamp electrodes. A number of fluorescent lamps were then processed using the barium tantalate coating and were evaluated for lamp starting and for the formation of end discoloration.

Figure 1:
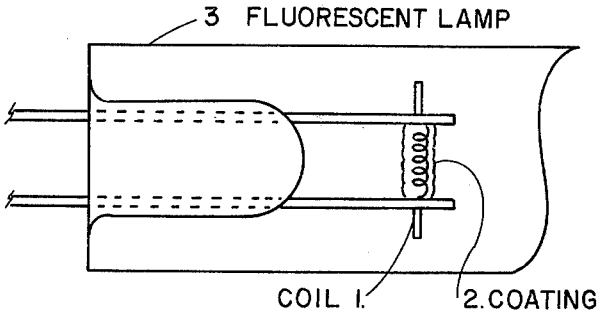
FIG. 1 is a front view of one end of a fluorescent lamp containing an electron emissive cathode.
Figure 2:
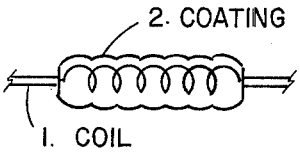
FIG. 2 is an enlarged view of the electrode of FIG. 1.

The particular lamps chosen were the 96T12 slimline type which consist of an eight foot long, one and one-half inch diameter lamp containing a single electrode at each end of the lamps. The lamp 3 showing the electrode to consist of a coil 1 and a coating 2 is shown in FIG. 1. The lamps are operated in a so-called "instant start" type operation in which the tungsten coil 1 coated with the barium tantalate mix 2, as shown in FIG. 2, comprise the electrodes and are heated to thermionic emission by means of electron and ion bombardment from the ionized gas so that starting occurs when the electrodes become thermionic emissive and the lamp becomes fully ionized. A measure of the lamp starting voltage, defined as the voltage applied to the lamp by means of the aforementioned electrodes, which is sufficient to cause the electrodes to become heated to thermionic emission and for the lamp to become fully ionized is a good indication of the electron emission efficiency of the electrodes for this particular lamp type. A statistical quantity of lamps using the aforementioned tantalate composition resulted in starting voltage measurements having an average value of 450 volts.

In order to determine the end discoloration formation rate the lamps were then put on a standard life test burning cycle where the lamps were continuously operated on a three hour on-cycle with 20 minute off periods for each cycle. End discoloration was then recorded as a function of lamp burning time. It was found for the first group of lamps tested having the particular barium tantalate composition and firing schedule that the end discoloration occurred within 20 hours of burning.

The same original batch of barium tantalate was then fired in a series of steps in excess of 1000°C and visual observations were made in order to determine the color of the tantalate for each firing schedule. The lamps that were subsequently processed having the various tantalate coatings were also evaluated for lamp starting voltage and end discoloration formation rate. The relationship between the end discoloration rate for the lamps as a function of time is shown graphically in FIG. 3 where the barium tantalate firing temperatures for each electrode firing group are listed.

Visual indications confirm that firing temperatures in excess of 1450 Centigrade degrees caused the transition from grayish brown to grayish white in tantalate body color. The body color for this range of experiments gradually becomes less grayish and more white as the temperature was increased to the vicinity of 1500 Centigrade degrees and higher. Subsequent measurements showed that the lamp starting voltage for lamps with electrodes containing the material fired at 1600°C was in the order of 450 volts. The formation of end discoloration for the batch processed at 1600°C did not occur until the lamps employing electrodes containing this material had operated on the cycle test for several thousand hours.

Spectroscopic observations on the cathode glow which occurs in the region of ionized vapor in the close vicinity of the electrodes showed the presence of a reddish glow which is characteristic of the barium emission spectrum. The lamps operating with the barium tantalate fired at the higher temperatures showed significantly less occurrence of the barium lines present in the so-called negative glow in the close vicinity of the electrodes. Electrodes containing coatings fired in excess of 1600°C showed the complete absence of barium line spectra.

Starting voltage measurements on the lamps containing the barium tantalate emissive coating fired at 1675°C showed an average initial starting voltge of 450 volts which remained substantially constant out to 10,000 hours of operation.

Since the barium tantalate emissive coating either as a powder or as a sintered pellet is believed to assume electron emissive properties somewhat similar to a degenerate semiconductor made oxygen deficient by heating in the absence of oxygen, electrical conductivity mesurements were made on the various fired coatings to determine whether the electrical properties of the electrode coating independent of lamps could be determined. A sample of each emissive coating fired to the aforementioned temperatures was pressed into cylindrical pellets and fired for ten minutes at 1600°C before cooling to room temperature in the absence of oxygen. The electrical resistance of each pellet was then measured in order to determine the electrical conductivity through the pellet. These measurements showed that the lower firing temperatures yielded pellets that had a few ohms resistance and indicated that the coating behaved as an electrical conductor. The intermediate firing temperature ranges (1200° – 1400°C) showed electrical resistance in tens of thousands of ohms which indicated that the coatings behaved somewhat similar to a semiconductor. The higher firing temperature (1600° – 1750°C) showed resistances in the megohm region indicating that these particular coatings behaved at least at room temperature as an electrical insulator.

Figure 5:
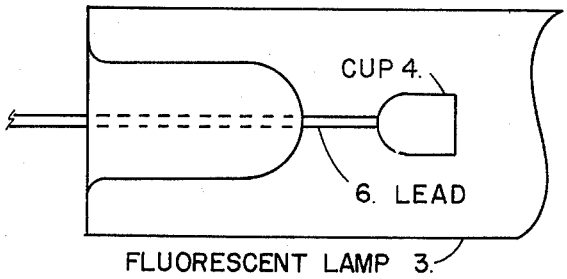
FIG. 5 is a front view of a fluorescent lamp containing the electrode of FIG. 4.
Figure 4:
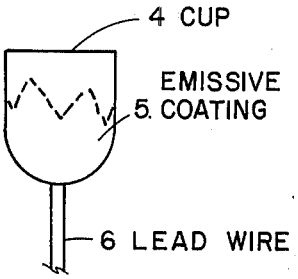
FIG. 4 is an enlarged view of a fused emissive coating electrode.
Figure 3:
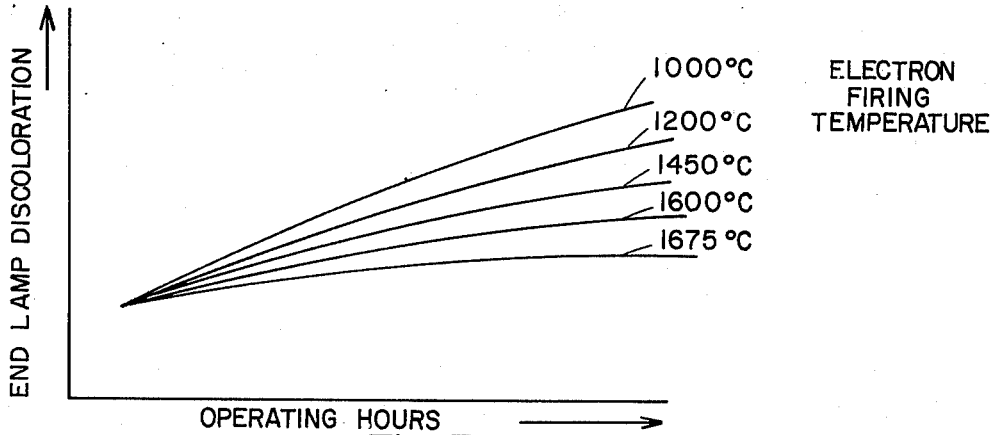
FIG. 3 is a plot of the end discoloration rate formation as a function of operating time for electrodes fired at increasing temperatures.

One other type of electron emissive material, as disclosed in the aforementioned U.S. Patent issued to R. Menelly, which comprised a fused pellet made from the exothermic fusion between barium peroxide and tantalum metal powder was also evaluated by this method of exces alkaline earth metal clean-up in order to improve the early end discoloration that occurs when this particular electrode is used in fluorescent lamps. This electrode, as shown in FIG. 4, consisted of an iron cup 4 containing a fused emissive coating 5 and a lead wire 6 for providing electrical connection when mounted in a lamp. FIG. 5 shows the cup 4 mounted within a fluorescent lamp 3 by means of the lead wire 6. These electrodes were heated to the same range of temperatures indicated earlier for the barium tantalate emissive coatings and showed the identical relationship as the barium tantalate relative to end discoloration as depicted in FIG. 3.

When the lamps that were processed with the fused emissive coating electrodes were evaluated for starting voltage as a function of time, the lamp starting voltage was found to increase with increasing firing temperature from 450 volts for the 1000°C fired electrodes, to 500 volts for the electrodes fired at 1675°C.

Figure 6:
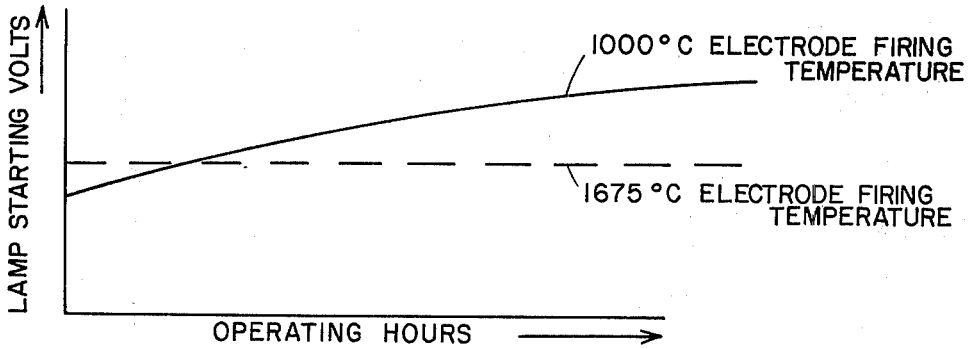
FIG. 6 is a plot of the relation between lamp starting voltage and operating time for two different electrode firing temperatures.

The lamps having the electrodes fired at 1675°C maintained a constant starting voltage of 500 volts out to 20,000 hours operation, whereas the lamps having electrodes fired at 1000°C increased in starting voltage with continued operation until they were no longer able to start on the voltages available from standard lamp circuits and had to be removed from the test. The relation between lamp starting voltage and electrode firing temperatures as a function of time is shown graphically in FIG. 6. The lamps containing the fused emissive coating electrodes fired at 1000°C started initially lower but increased in lamp starting voltage to a value higher than the lamps containing the fused emissive coating electrodes fired at 1675°C within a few hundred hours of operation.

Since the presence of elemental barium is known in the fluorescent lamp industry to promote the release of electrons from the electron emissive coating, and to thereby result in low lamp starting voltages, the increase in the lamp starting voltage with the higher firing temperatures is indicative of the clean-up of the excess barium from the fused barium-tantalum-oxygen mix.

Since the evaporation rate of barium metal from the fused emissive coating electrodes is known to be accelerated by increasing the lamp operating current above 0.800 ampere operation, several of the lamps having the fused emissive coating fired at 1000°C were compared to lamps having electrodes fired at 1600°C by operating both groups of lamps at 2ampere lamp operating currents in order to determine the end discoloration rate formation and the lamp operating life. To accelerate the end discoloration formation rate and ultimate lamp failure the lamps were operated on an accelerated test cycle consisting of 40 minutes of operation with 20 minutes off-time in order to assure that the cathodes are relatively cool when starting is caused to reoccur once per hour. The lamps with electrodes fired at 1000°C end-darkened severely in a few hours operation and failed within 100 – 200 hours. The lamps with electrodes fired at 1600°C operated in excess of one year without the occurrence of end discoloration.

A further observation which tends to support the excess barium clean-up theory by means of higher firing temperatures is the absence of the pungent odor which occurs with the fused emissive coating when first exposed to air after firing and cooling in the absence of oxygen. This pungent odor is believed to be a form of acetylene resulting from the reaction that quite often occurs when elemental barium is exposed to air to form barium carbide and barium hydroxide resulting in the evolution of acetylene gas. The fused emissive coatings heated to 1600°C and cooled in the absence of oxygen when exposed to air showed no such pungent odor and hence no formation of acetylene, whereas the evolution of acetylene was pronounced for the electrodes fired at 100°C and decresed to non-existent for those electrodes fired approximately at 1600°C.

Although the method of treating both alkaline earth tantalate emissive coatings and density gradient structure electrodes formed by the exothermal fusion of barium peroxide and tantalum powder have shown to provide fluorescent lamps with long operating lifetimes and a substantial decrease in the end discoloration formation rate, the method of treatment for these electrodes is not in any way limited to fluorescent lamp electrodes but may show beneficial electron emissive properties in any applications wherein these electrodes may be employed.

What is claimed is:

1. A method of treating electron emissive barium tantalate coatings in order to improve the electron emissive properties over the operational life of the coatings comprising the following steps:

placing the coating in an oxygen free environment;

heating the coating to at least 1200°C for one to ten minutes to remove excess free barium from the tantalate; and cooling the coating within the oxygen free environment.

2. A method of treating electron emissive barium tantalate coatings comprising the steps of:

heating the coating within an oxygen free environment to a temperature range of from 1200°C to 1750°C for a period from one to ten minutes; and cooling said coating within said oxygen free environment.

3. The method of claim 2 wherein said electron emissive barium tantalates comprise barium calcium tantalate.

4. A method of treating electron emissive barium tantalate coatings in order to provide constant electron emissive properties over the operating life of the coating comprising:

heating the coating in an oxygen free environment to a temperature in excess of 1600°C;

maintaining the coating at said temperature for one to ten minutes; and cooling said coating within said oxygen free environment.

* * * * *